US005983778A

United States Patent [19]

Dawson

[11] Patent Number: 5,983,778

[45] Date of Patent: Nov. 16, 1999

[54] TELESCOPIC HYDRAULIC HOIST APPARATUS

[75] Inventor: Steve Dawson, Collingwood, Canada

[73] Assignee: Dawson Hydraulics, Inc., Barrie, Canada

[21] Appl. No.: 08/901,089

[22] Filed: Jul. 28, 1997

[51] Int. Cl.[6] ..... F01B 7/20

[52] U.S. Cl. ..... 92/52; 92/51; 92/53; 92/79; 92/85 B

[58] Field of Search ..... 92/51, 52, 53, 92/79, 165 R, 85 B, 143; 91/167 R

[56] References Cited

U.S. PATENT DOCUMENTS 3,958,376 5/1976 Campbell .
4,471,944 9/1984 Leray .
4,928,488 5/1990 Hunger .
5,322,602 6/1994 Sims ..... 92/52
5,390,586 2/1995 Jones ..... 92/79
5,400,695 3/1995 Walker ..... 92/51
5,562,393 10/1996 Focke et al. ..... 414/626

*Primary Examiner*—Thomas E. Denion
*Attorney, Agent, or Firm*—Dimock Stratton Clarizio; Mark B. Eisen

[57] ABSTRACT

A telescoping hydraulic hoist formed from a non-corrosive material provides bearings and hydraulic seals about the bottom portion of each intermediate moving stage. The bearings and hydraulic seals are thus always maintained within the hoist and are not exposed to dust or particulate matter from outside the hoist. Air flows into and out of the air spaces between adjacent stages through air breathers. The hoist may also include variable length stroke limiters, and a cushion member which partially closes off the hydraulic inlet as the innermost stage is fully retracted to slow the hoist motion in the final stages of retraction.

20 Claims, 2 Drawing Sheets

TELESCOPIC HYDRAULIC HOIST APPARATUS

BACKGROUND OF THE INVENTION

1. Field of the Invention

This invention relates to telescopic hydraulic hoist mechanisms, and in particular to such mechanisms that are made from rolled aluminum stock, are fast-acting; have greater bearing life and air breathers for the space between hydraulic stages, thereby preventing dirt from being sucked into the hydraulic mechanism.

2. Related Art

The Commercial Intertech Distribution Services Hydraulic Cylinder Division catalogue, (Date ?) pages 24–34 illustrates a number of "Dump Cylinder Identification Drawings" each representing a particular telescopic hydraulic mechanism respectively identified as: "ANTHONY"; "COMMERCIAL"; CUSTOM HOIST"; "FONTAINE"; "PEABODY GALION"; "GLENCO/FARMHAND"; "HEIL "OLD STYLE""HPT SERIES"; "HEIL "NEW STYLE" HPT SERIES"; "HYCO 900-2000 SERIES"; "HYCO 10,000 SERIES"; "HYCO 30,000 SERIES"; "HYCO 70,000 SERIES"; JOHNSON"; "LESSARD";"MAILHOT/"C" MODEL"; "MAILHOT/"M" MODEL COVER TUBE DESIGN"; "MARION MFCG."; NORDIC/NORD-SEN METAL INDUSTRIES"; "PERFECTION"; "PERFECTION FARM HOISTS"; "PRINCE"; and "WARD CO". These telescopic hydraulic dump cylinders collectively disclose various state-of-the-art features of such mechanisms, for example an oil port in the base trunnion and various seal mechanisms.

Additionally, U.S. Pat. No. 3,958,376 to Campbell and entitled: "Extendible Tower Structure" discloses a plurality of nesting tower sections that can be telescopically raised into an extended position for supporting a load thereat. Hydraulic cylinders within the tower sections extend the tower sections.

U.S. Pat. No, 4,928,488 to Hunger and entitled: "Hydraulically-Operated Support Device for Semitrailers" discloses an extending cylinder in the bottom of which is formed a load-raising cylinder for a load-raising piston. A pump subassembly includes three independently operable pumps for generating and controlling the hydraulic operating pressure.

Finally, U.S. Pat. No. 4,471,944 to Leray et al. and entitled: "Telescopic Jack" discloses a plurality of coaxial tubular telescopic elements mounted within a cylinder and each pair of adjacent tubular telescoping elements has two pairs of cooperating annular recesses on their inner and outer surfaces which cooperate with an elastic ring to limit the outward movement of an inner tubular element relative to its adjacent outer element.

The prior art telescopic hydraulic mechanisms are prone to abnormal wear of their bearings, operate slowly, have inadequate sealing which admits dirt into the hydraulic cylinders and are heavy.

SUMMARY OF THE INVENTION

A primary object of the invention is to provide a telescoping hydraulic hoist of the type specified herein and which is significantly lighter than prior art hoists of similar type.

It is a feature of the present invention that the telescopic hydraulic hoist is made of drawn-over-manual (DOM) aluminum tubing consisting of a specially formulated alloy.

An advantage of the present invention is that the hydraulic hoist is lighter and more easily transported and positioned for use than similar prior art devices.

Another object of the present invention is to provide a telescoping hydraulic hoist of the type specified herein and which has increased operating speed.

It is a feature of the present invention that the telescopic hydraulic hoist may be contracted or expanded at increased speed over that obtained by such hoists constructed of steel.

It is an advantage of the present invention that the telescoping hydraulic hoist moves rapidly into or out of operating position.

It is a further object of the invention to provide a telescoping hydraulic hoist of the type specified herein that prevents dirt from being sucked passed the wipers.

It is a feature of the present invention to provide space between the stages above the seals so that air breathes therein to prevent dirt from entering the seals between the telescopic stages.

It is a further advantage of the invention that dirt is prevented from entering the seals between the telescopic stage of the hydraulic hoist.

It is yet a further object of the invention to provide a telescoping hydraulic hoist having extended life.

It is yet a further feature of the invention that the tube surface provides a wearing surface for the bearings.

It is yet a further advantage of the invention that the bearings of each stage coact with the telescopic tube surface.

BRIEF DESCRIPTION OF THE DRAWINGS

The above objects, features and advantages of the invention are believed readily apparent from the following description of a preferred embodiment of the best mode of carrying out the invention, wherein.

DETAILED DESCRIPTION

Figure 1:
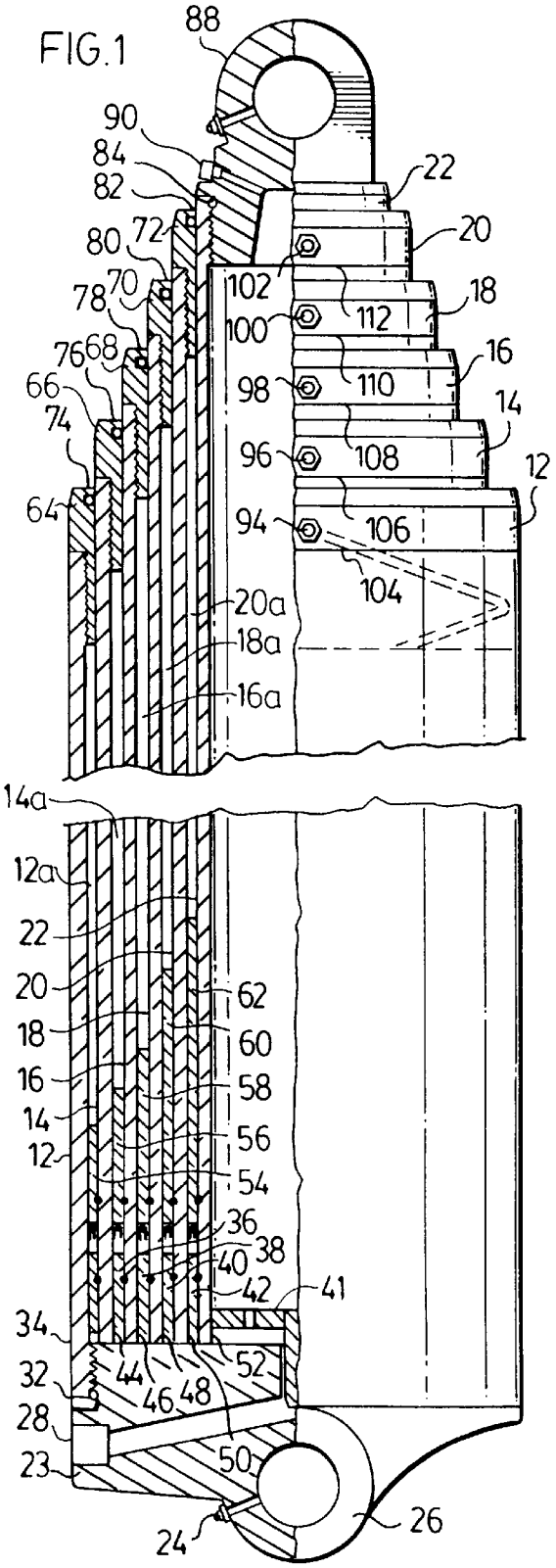
FIG. 1 is a partial side sectional view of the aluminum hydraulic telescopic hoist according to the invention.
Figure 3:
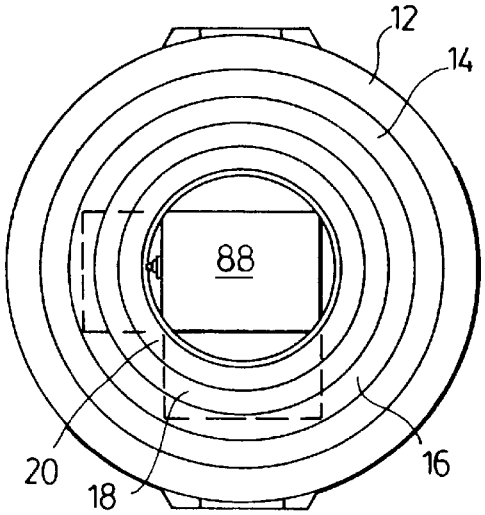
FIG. 3 is a top view of the hydraulic hoist.
Figure 2:
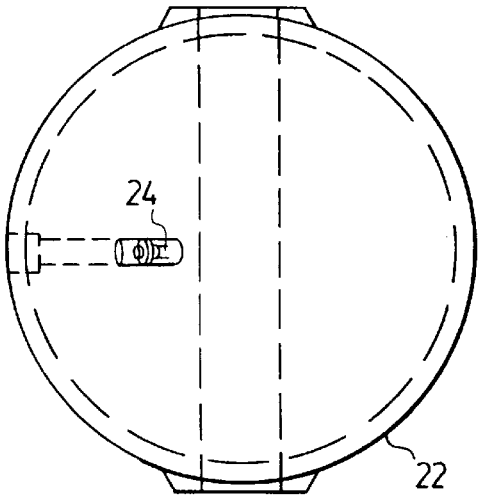
FIG. 2 is a bottom view of the hydraulic hoist.

Formerly, hydraulic telescopic hoists were made from steel alloy tubing and consequently they were heavy and subject to corrosion. In accordance with the present invention, the hydraulic telescopic hoist is made of an aluminum alloy tubing and is thereby considerably lighter and is not subject to corrosion. A suitable aluminum alloy for the purposes of the present invention has the following exemplary composition: Silicon 0.35; iron 0.40; copper 0.10; manganese 0.20–0.7; magnesium 1.0–1.8; chromium 0.06–0.20; zinc 4.0–5.0; titanium 0.01–0.06; zirconium 0.08–0.20; misc. trace elements 0.05–0.15; aluminum remainder.

The aluminum alloy tubes in the exemplary embodiment of the invention described herein typically have a variable length dependent on the desired telescopic length of the hoist and a thickness of substantially 0.050".

FIG. 1 illustrates an aluminum alloy hydraulic hoist 10 having five stages 12, 14, 16, 18, 20 and 22 in the non-extended position and mounted to a base casting 23. Grease nipple 24 provides a means for applying grease to rod eye casting 26, which enables attachment of the hydraulic hoist 10 to either the bed of a dump truck or the frame of a dump truck, for example, thereby enabling the bed of the dump truck to be elevated. Base casting 23 includes hydraulic fluid inlet 28 and threaded portion 30 (FIG. 4) for attaching a first stage aluminum alloy tube 12 thereto. An O-Ring 32 is provided as a seal as indicated in FIG. 1. An extra wide bearing 34, 36, 38, 40 and 42 is respectively provided for aluminum alloy tube stages 12, 14, 16, 18, 20 and 22 and including respective stop rings 44, 46, 48, 50 and 52.

Variable length stroke limiters 54, 56, 58, 60 and 62 are mounted within hoist 10 to provide respective stroke lengths of movement of each of hydraulic stages 12, 14, 16, 18, 20 and 22 as illustrated in FIG. 1. Gland nut bearings 64, 66, 68, 70 and 72 are respectively provided at the upper end of exterior housing 10 and the upper ends of hydraulic stages 12, 14, 16, 18, 20 and 22. Heavy duty wipers 74, 76, 78 80 and 82, made of rubber or some other suitable material, are fixed to each of the upper portions of respective bearings 64, 66, 68, 70 and 72. An O-ring is fitted between inner casing 86 and rod-eye casting 88, and which is fitted with air bleeder 90 connecting with the inside 92 of the hydraulic hoist 10.

Figure 4:
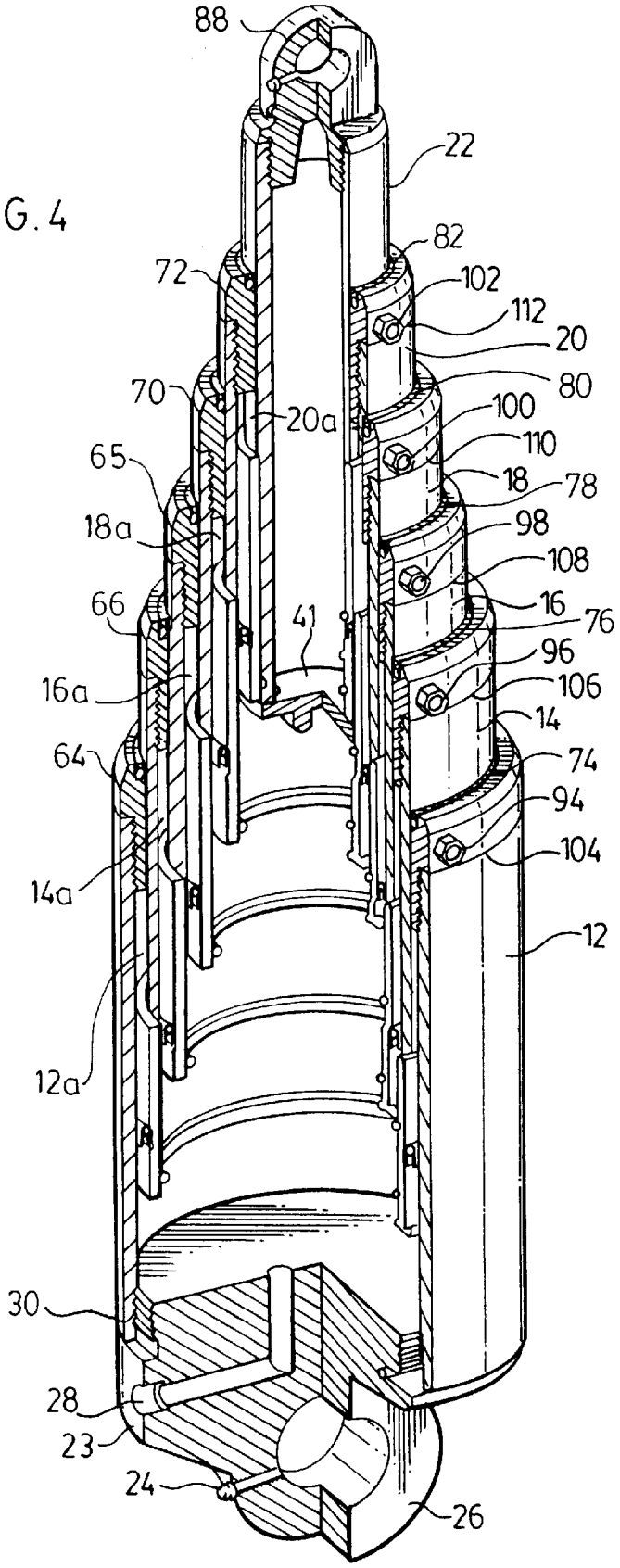
FIG. 4 is a partial cut away view of the aluminum hydraulic hoist in an extended position.

Single-acting air breathers 94, 96, 98, 100 and 102 are positioned on each of hydraulic stages 12, 14, 16, 18, 20 and 22 as illustrated in FIGS. 1 and 4. Locking screws 104, 106, 108, 110 and 112 serve to retain each respective gland nut bearing 64, 66, 68, 70 and 72 in its respective tube stage 12, 14, 16, 18 and 20; and thereby retain each of said tube stages with respect to an adjacent tube stage.

The air breathers 94, 96, 98, 100 and 102 each respectively communicate with an air space 12*a*, 14*a*, 16*a*, 18*a* and 20*a*, so that as each tube stage extends and the stroke limiters 54, 56, 58, 60 or 62 approach the adjacent gland nut bearings 64, 66, 68, 70 or 72, the volume of the air space decreases and air in the air space is forced out of the spiral groove along the interior surface of the gland nut bearing (shown in phantom in FIG. 1) and through the respective air breather 94, 96, 98, 100 or 102. Similarly, as each hydraulic stage 12, 14, 16, 18, 20 or 22 is retracted, the volume of the air space increases and air is drawn through the air breathers 94, 96, 98, 100 or 102 and into the air spaces 12*a*, 14*a*, 16*a*, 18*a* or 20*a* through the spiral channel. This prevents air from being drawn through the wiper 74, 76, 78, 80 or 82, which would tend to suck particulate material into the bearing and scratch or mar the outer surface of the adjacent tube stage. The air breathers 94, 96, 98, 100 and 102 are preferably provided with filters to clean air as it is drawn into the air spaces 12*a*, 14*a*, 16*a*, 18*a* and 20*a*.

With the hydraulic device 10 positioned between the bed of a dump truck and the frame thereof (not shown) the introduction of hydraulic fluid into the hydraulic device 10 through fluid inlet 28, the various hydraulic stages 12, 14, 16, 18 and 20 extend from the position illustrated in FIG. 1 to that shown in FIG. 4, whereby air is caused to escape from air breathers 94, 96, 98, 100 and 102 thereby enabling each stage of the hydraulic device to more rapidly move from a collapsed position as shown in FIG. 1 to an expanded position as shown in FIG. 4. In the preferred embodiment a cushion member 41 is mounted in the base of the inner tube 22 over and extending into the hydraulic fluid inlet 28. After the hydraulic tube stages 16, 18, 20 and 22 have collapsed to the retracted position, the cushion member 41 is forced downward into the fluid inlet 28, constricting the fluid inlet 28. Thus, as intermediate stage 14 collapses, the tubes 14, 16, 18 and 20 slow down considerably as the hydraulic fluid inlet 28 becomes; partially sealed off, which increases the life of the telescopic hoist by preventing percussive interaction between the tube stages 14, 16, 18, 20 and 22 and the base casting 23.

The following features of the invention are evident from a consideration of the preceding description:

1.) The hydraulic hoist is double-acting as hydraulic fluid may be fed from either end;

2.) The various components of the hydraulic hoist are not welding, thereby preventing any distortion of the hydraulic hoist;

3.) Because the stages are threaded, the hydraulic device is easily maintained;

4.) There is a long overlap of the hydraulic stages thereby enabling the hydraulic hoist to have a long overall extension and which is achieved by bringing each of the various stages to the base and thereby increasing the strength of the hydraulic hoist;

5.) Because the various stages are sealed on the inside, scratches or dents on the exposed stages surfaces do not effect sealing;

6.) There is a quicker response of the hydraulic stages due to the hydraulic feed and the fact that no wear bands pass a port; and 7.) The use of air breathers which prevents dust and dirt from entering the hydraulic stages.

The above description serves only to describe exemplary embodiments of the best mode of making the invention to demonstrate the features and advantages of its construction and operation. The invention is not intended to be limited thereby, as those skilled in the art of product-retention packages will readily perceive modifications of the above-described embodiments. Thus the invention is intended to be limited only by the following claims and the equivalents to which the claimed components thereof are entitled.

What is claimed is:

1. A telescopic multi-stage hydraulic hoist, comprising:

a hydraulic fluid inlet, a base member, a non-corrosive outer tube having a first end attached to the base member with a seal therebetween and a second open end, at least one non-corrosive intermediate tube disposed within the outer tube in telescoping relation, the intermediate tube having an inner end and an outer end and being extendible through the open end of the outer tube to an extended position and retractable through the open end of the outer tube to a collapsed position, a hydraulic seal extending about a lower portion of the intermediate tube forming a seal between the intermediate tube and the outer tube, a gland nut bearing affixed to the open end of the outer tube, for spacing the intermediate tube from the outer tube, an inner bearing affixed about a lower portion of the intermediate tube for spacing the inner end of the intermediate tube from the outer tube, thereby creating an air space defined between the intermediate tube and the outer tube, and an air breather extending through the outer tube in communication with the air space;

whereby when the intermediate tube is extended relative to the outer tube a volume of the air space decreases and air is forced out of the air breather, and when the intermediate tube is retracted into the outer tube the volume of the air space increases and air is drawn into the air breather.

2. The telescoping hydraulic hoist of claim 1 wherein the air breather is in communication with the air space through a spiral channel disposed about an interior surface of the gland nut bearing.

3. The telescoping hydraulic hoist of claim 1 wherein the air breather comprises a filter for filtering air drawn into the air space.

4. The telescoping hydraulic hoist of claim 1 comprising a cushion member disposed within the fluid inlet, for closing off the fluid inlet as the hoist is retracted to a fully collapsed position.

5. The telescoping hydraulic hoist of claim 1 comprising a locking screw for retaining the gland nut bearing in a fixed position relative to the outer tube.

6. The telescopic hydraulic hoist of claim 1 further comprising a stroke length limiter disposed about an intermediate portion of the intermediate tube, which abuts against the gland nut bearing as the intermediate tube is extended to a fully extended position.

7. The telescoping hydraulic hoist of claim 1 wherein the hydraulic seal is positioned adjacent to the inner bearing.

8. The telescoping hydraulic hoist of claim 1 wherein the gland nut bearing comprises a wiper forming a seal against the intermediate tube.

9. The telescoping hydraulic hoist of claim 1 wherein the outer tube is threadedly engaged to the base member.

10. The telescoping hydraulic hoist of claim 1 comprising a rod eye threadedly engaged to an open end of a central tube and sealed thereto.

11. The telescoping hydraulic hoist of claim 10 wherein the rod eye casting comprises an air bleeder.

12. The telescoping hydraulic hoist of claim 1 comprising a plurality of intermediate tubes.

13. A telescopic multi-stage hydraulic hoist, comprising:

a hydraulic fluid inlet, a base member, a non-corrosive outer tube attached to the base member with a seal therebetween, a plurality of non-corrosive intermediate tubes disposed within the outer tube in telescoping relation, each of the intermediate tubes being extendible to an extended position and retractable to a collapsed position within the outer tube, a hydraulic seal extending about a lower portion of each intermediate tube forming a seal between the intermediate tube and a next adjacent tube, a gland nut bearing affixed to an open end of the outer tube and to an open end of at least some of the intermediate tubes, for spacing each tube from a next adjacent tube, inner bearings affixed about at least some of the intermediate tubes for spacing inner ends of each intermediate tube from a next adjacent tube, thereby creating an air space defined between adjacent tubes, an air space between each intermediate tube and a next adjacent tube, defined between the gland nut bearing and the stage seal, and air breathers permitting communication between air outside of the hoist and each air space, extending through the outer tube stage and through at least some of the intermediate tube stages, whereby when a tube, is extended relative to a next adjacent tube, a volume of the air space decreases and air is forced out of the air breather, and when the intermediate tube is retracted into the outer tube the volume of the air space increases and air is drawn into the air breather.

14. The telescoping hydraulic hoist of claim 13 wherein each air breather is in communication with an adjacent air space through a spiral channel disposed about an interior surface of the gland nut bearing.

15. The telescoping hydraulic hoist of claim 13 wherein the air breather comprises a filter for filtering air drawn into the air space.

16. The telescoping hydraulic hoist of claim 13 comprising a cushion member disposed within an innermost tube, for partially closing off the fluid inlet as the hoist is retracted to a fully collapsed position.

17. The telescoping hydraulic hoist of claim 13 comprising a locking screw for retaining each gland nut bearing in a fixed position relative to the tube to which it is affixed.

18. The telescopic hydraulic hoist of claim 13 further comprising a stroke length limiter disposed about an intermediate portion of each of the intermediate tubes, which abut against an adjacent gland nut bearing as each intermediate tube is extended to a fully extended position.

19. The telescopic hydraulic hoist of claim 18 wherein the stroke length limiters are of varying lengths.

20. The telescoping hydraulic hoist of claim 13 wherein the hydraulic seals are positioned adjacent to the inner bearings.

* * * * *

UNITED STATES PATENT AND TRADEMARK OFFICE

CERTIFICATE OF CORRECTION

PATENT NO. : 5,983,778
DATED : November 16, 1999
INVENTOR(S) : Steve Dawson

It is certified that error appears in the above-identified patent and that said Letters Patent is hereby corrected as shown below:

Column 1,
Line 66, "manual" should be --mandrel--.

Column 2,
Line 62, "0.050" should be --0.50--.
Line 64, "12" should be deleted.

Column 3,
Line 20, "86" should be deleted.
Line 21, "92" should be deleted.
Line 52, "12" should be deleted.
Line 53, "18 and 20" should be --18, 20, and 22--.
Line 66, ";" should be deleted.

Column 4,
Line 8, "welding" should be --welded--.
Line 20, "effect" should be --affect--.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*